US005505638A

United States Patent [19]

Su et al.

[11] Patent Number: 5,505,638

[45] Date of Patent: Apr. 9, 1996

[54] TELEPHONE PLUG MODULE

[76] Inventors: Gorden Su, 7-4F, No. 33, Lane 200, Tung Hwa Street, Taipei; Max Chu, 3F, No.33, Lane 39, Po Chueh Street, Tsi Chih Chen, Taipei Hsien, both of Taiwan

[21] Appl. No.: 341,120

[22] Filed: Nov. 18, 1994

[51] Int. Cl.[6] ..... H01R 23/02

[52] U.S. Cl. ..... 439/676; 439/374; 439/701

[58] Field of Search ..... 439/395–404, 439/417–419, 676, 696, 701, 374

[56] References Cited

U.S. PATENT DOCUMENTS 4,875,875 10/1989 Archer et al. ..... 439/676
4,978,316 12/1990 Yahata ..... 439/676
5,244,412 9/1993 Hatch et al. ..... 439/676
5,281, 170 1/1994 Murphy ..... 439/676

*Primary Examiner*—David L. Pirlot
*Attorney, Agent, or Firm*—Varndell Legal Group

[57] ABSTRACT

A telephone plug module including a plug body, and insert inserted into the plug body to carry a telephone line permitting the conductors to be respectively fastened to respective contact metal strips in respective grooves on the plug body, wherein the plug body has a downward locating hole on the inside, a vertical stop wall and a back flange and a beveled tail on the outside; the insert has a retaining block fitted into the downward locating hole to prevent backward movement of the insert relative to the plug body, and a vertical stop wall stopped against the vertical stop wall of the plug body, and two curved projecting strips stopped against the back flange and bevel tail of the plug body.

1 Claim, 8 Drawing Sheets

TELEPHONE PLUG MODULE

BACKGROUND AND SUMMARY OF THE INVENTION

The present invention relates to a telephone plug modules, and relates more particularly to an improved structure of telephone plug module which is easy to manufacture and install.

A telephone plug module may have different numbers of wire, for example, 4, 6, 8 or 10 wires. According to conventional telephone plug module manufacturing methods, it is not easy to insert the wires of a telephone line into position. FIGS. 1 and 2 show a regular 8-wire telephone plug module. The 8-wire telephone plug module comprises an integrally molded plug body having eight parallal slots longitudinally disposed at the top and respectively extended from the front end, a backward chamber defined on the inside, a plurality of parallel partition walls longitudinally disposed in the front narrow section of the backward chamber. The front narrow section of the backward chamber is disposed in communication with the eight parallel slots. When the eight conductors of a 8-wire telephone line are respectively inserted through the backward chamber into the eight grooves (not shown) among the partition walls, contact metal strips are punched into the eight parallel slots to hold down the conductors and to make a respective contact with the conductors (see FIG. 3). This structure of plug module is difficult to manufacture because it is not easy to insert the conductors into the eight grooves among the partition walls. When inserted, the conductors must be firmly retained in position before the process of punching. If any conductor is moved out of position during the process of punching a contact error will occur.

The present invention eliminates the aforesaid problem. The present invention uses a slotted insert to carry the conductors of the telephone line such that the conductors of the telephone line can be quickly and accurately inserted .into position. The plug body has a downward locating hole on the inside, a vertical stop wall and a back flange and a beveled tail on the outside. The insert has a retaining block, a vertical stop wall at the top, and two curved projecting strips at the bottom. When the insert is fastened to the plug body, the retaining block is forced into the downward locating hole to prevent backward movement of the insert relative to the plug body, the vertical stop wall of the insert stopped against the vertical stop wall of the plug body, and two curved projecting strips are stopped against the back flange and bevel tail of the plug body. Therefore, the connection between the plug body and the insert is secured.

DETAILED DESCRIPTION OF THE PREFERRED

Figure 1:
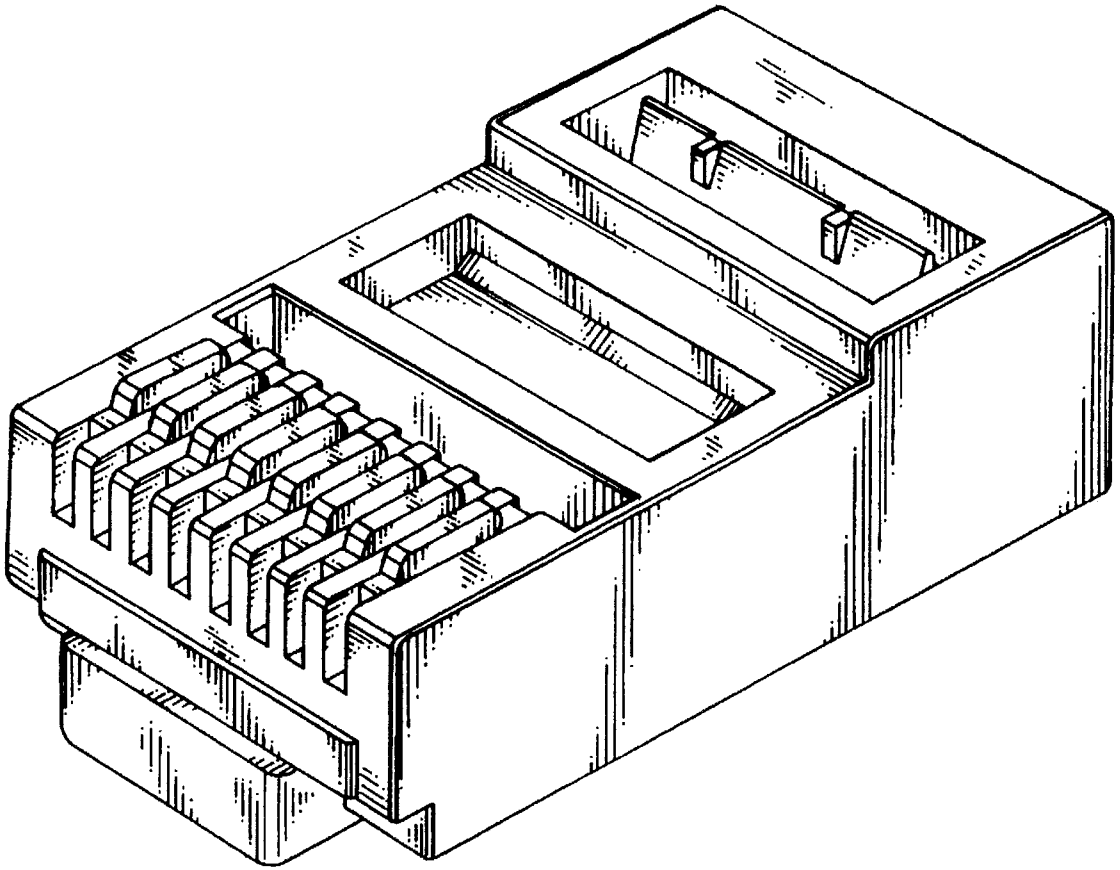
Fig. 1 PRIOR ART
FIG. 1 is an elevational view of a telephone plug module according to the prior art.
Figure 2:
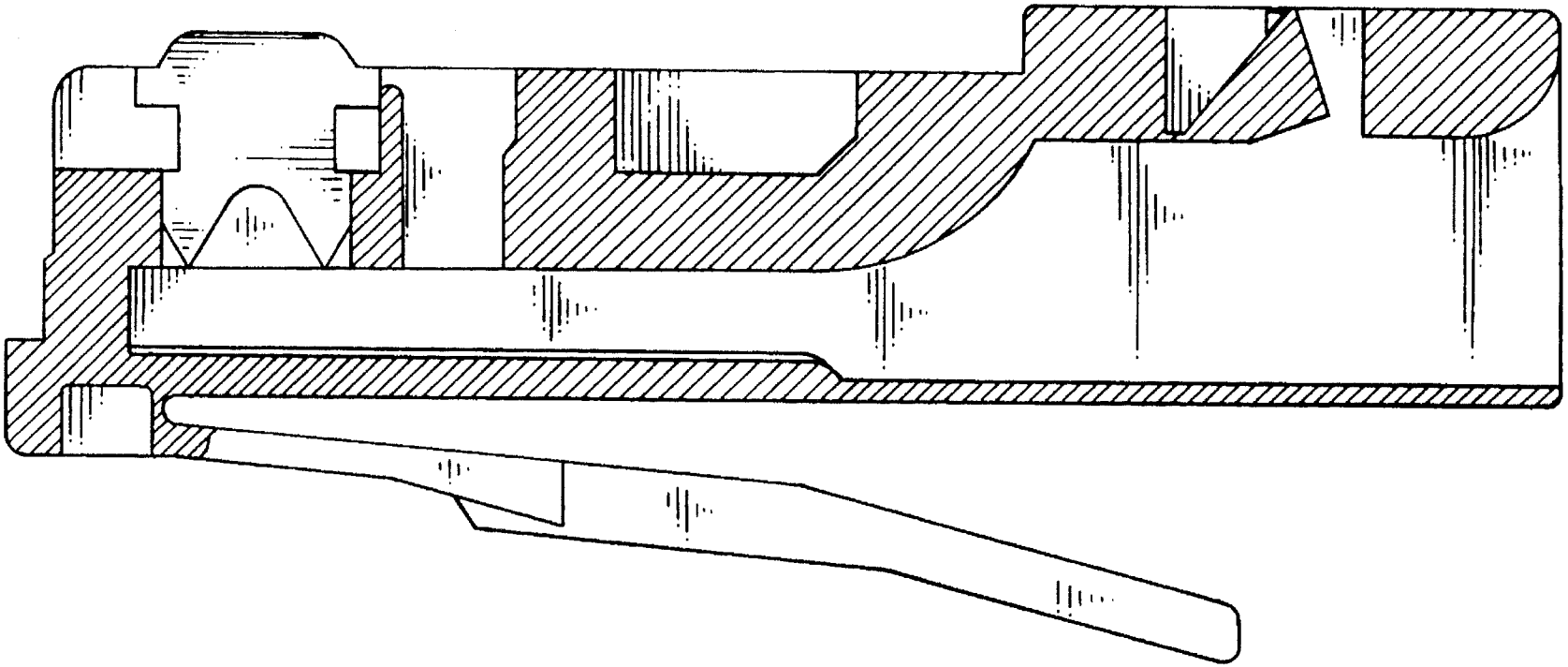
Fig. 2 PRIOR ART
FIG. 2 is a longitudinal view in section of the telephone plug module of FIG. 1 before the process of punching.
Figure 3:
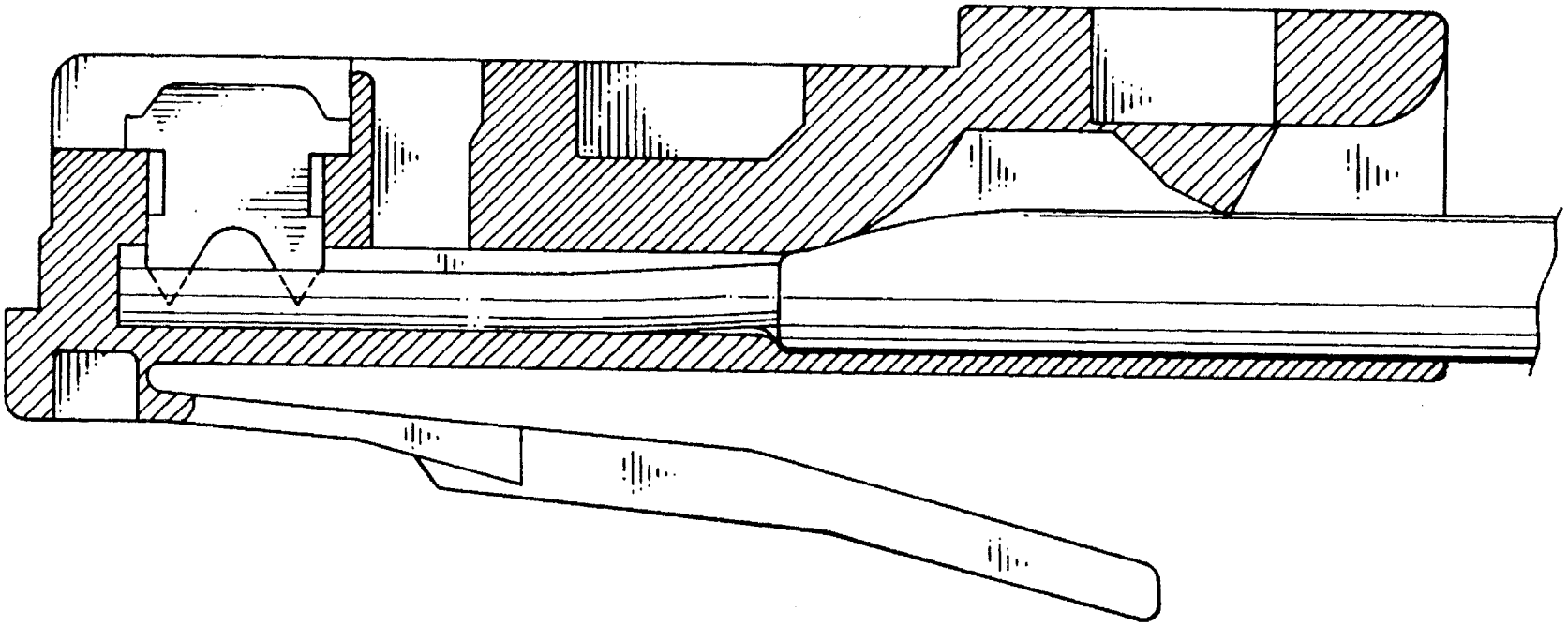
Fig. 3 PRIOR ART
FIG. 3 is a longitudinal view in section of the telephone plug module of FIG. 1 when assembled.
Figure 4:
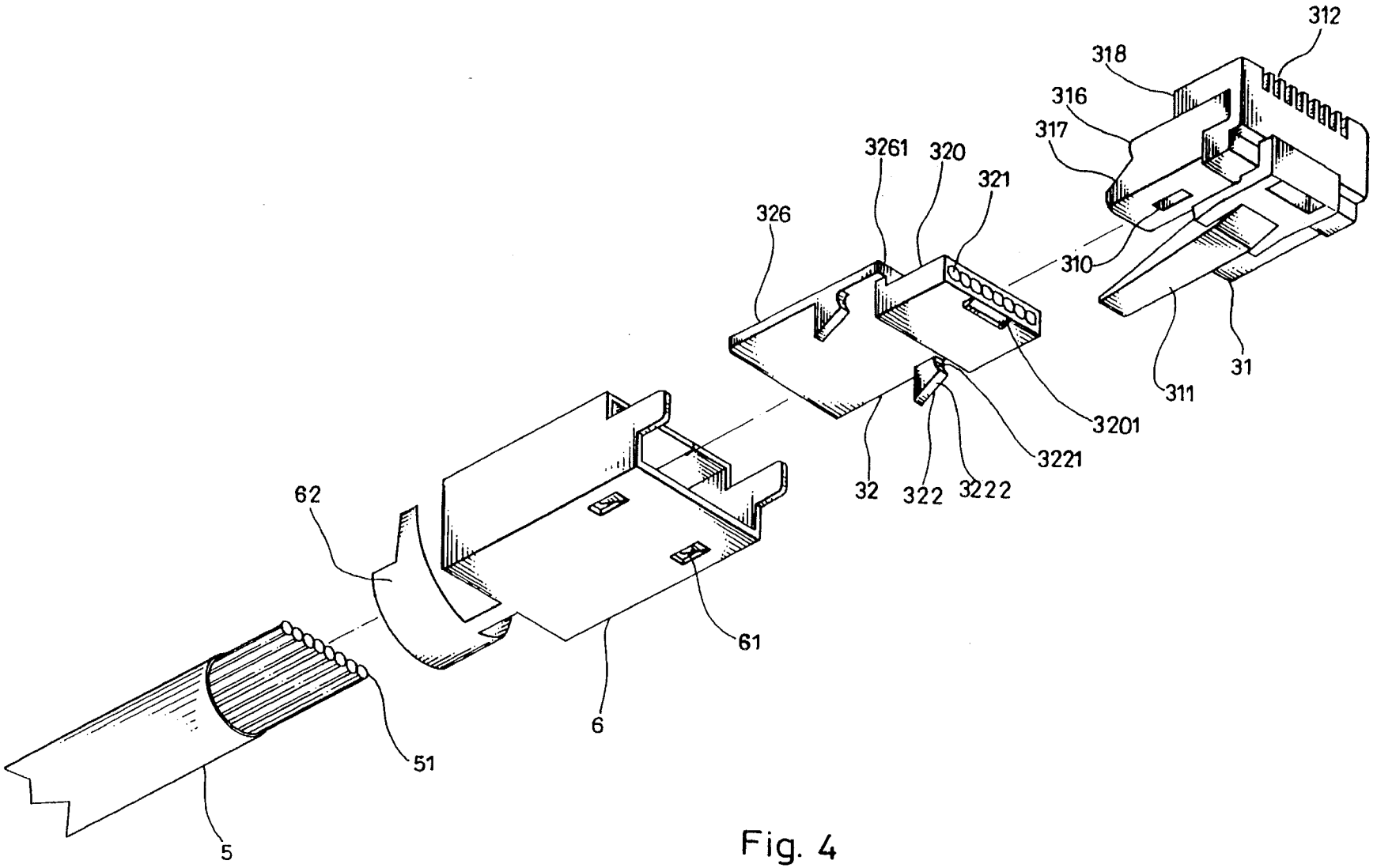
FIG. 4 is an exploded view of a telephone plug moduel according to the present invention.

Referring to FIGS. 4 through 8, a 8-wire telephone plug module 3 as constructed in accordance with the present invention is generally comprised of a plug body 31, an insert 32, a shell 6, and a 8-wire telephone line 5 having eight conductors 51.

Figure 6:
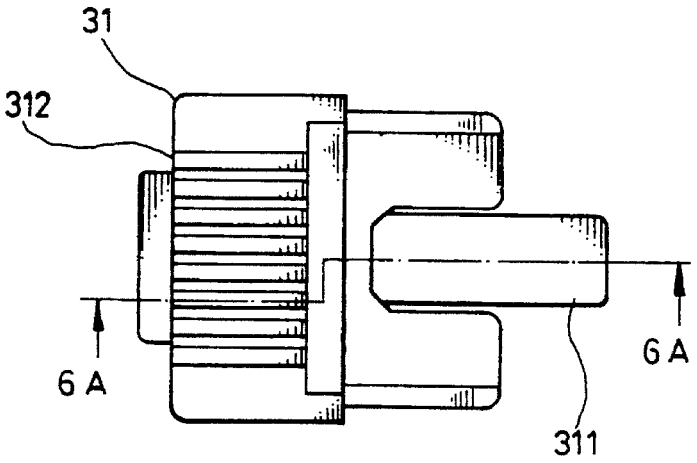
FIG. 6 is a top view of the plug body shown in FIG. 4.
Figure 6A:
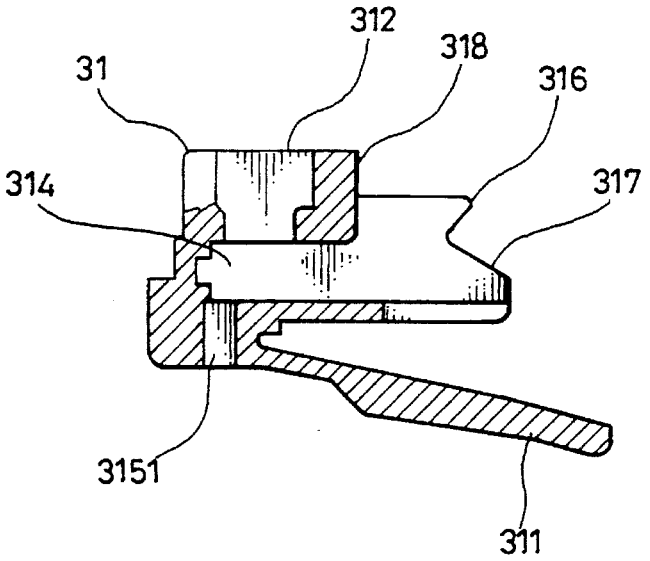
FIG. 6A is a sectional view taken along line 6A—6A of FIG. 6.
Figure 8:
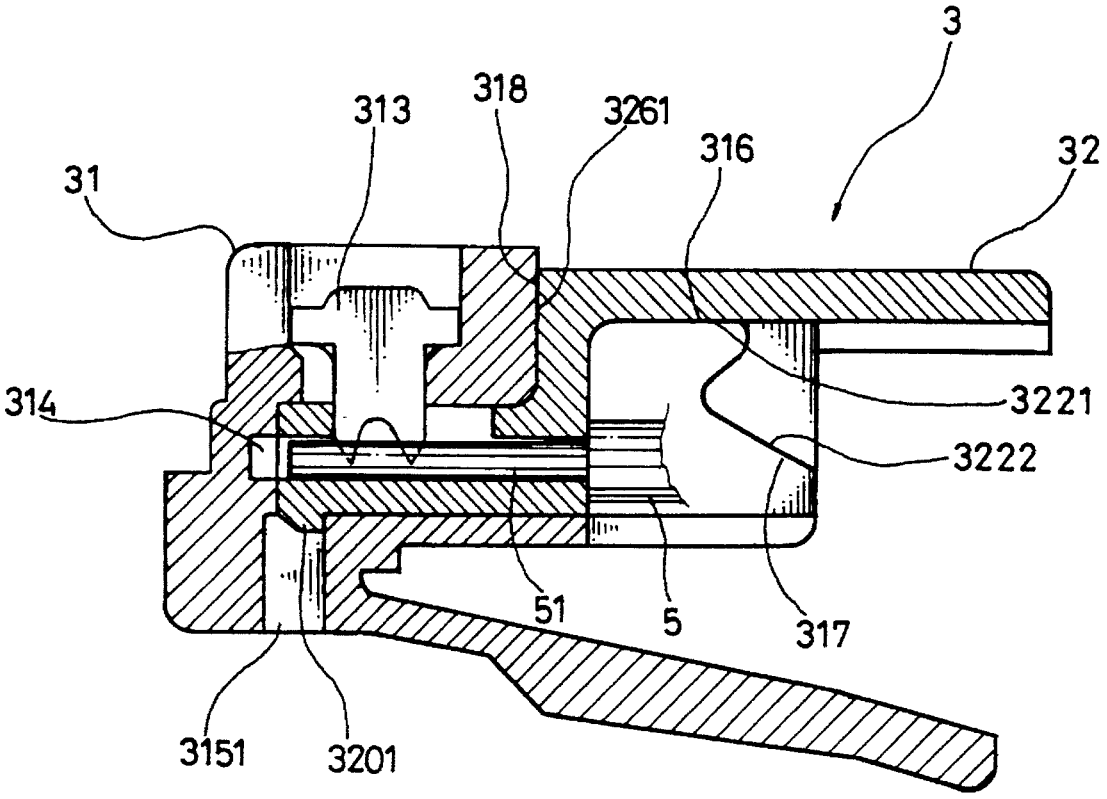
FIG. 8 is a partial view in section of FIG. 5, showning the telephone line fastened to the plug body and the insert.

Referring to FIG. 6A and 8 and FIG. 4 again, the plug body 31 is integrally molded from plastic, having a retainer rod 311 obliquely extending backwards from a front edge thereof for positioning telephone jack (not shown), a backward chamber longitudinally disposed on the inside, eight contact metal strips 313 respectively inserted in eight parallel grooves 312 thereof on the top at the front, a longitudinal backward chabmer 314 communicated with the grooves 312 to the back, into which the insert 32 is inserted, a beveled tail 317, a downward locating hole 3151 inside the backward chamber 314, a vertical stop wall 318 at the top near the back, a beveled tail 317 a back flange 316 spaced between the beveled tail and the vertical stop wall 318, and a plurality of bottom retaining holes 310 for the positioning of the shell 6.

Referring to FIG. 4 and 6A again, the insert 32 comprises a front part 320 and a rear part 326 disposed at different elevations. The front part 320 comprises eight parallel slots 321 corresponding to the eight grooves 312 on the plug body 31, which receive the eight wires 51 of the telephone line 5, eight vertical holes 3213 (see FIG. 6A) disposed at the top near the front end and respectively communicated with the eight parallel slots 321, and a retaining block 3201 at the bottom near the front end. The rear part 326 comprises a pair of downward projecting strips 322 bilaterally disposed at the bottom.

Figure 5:
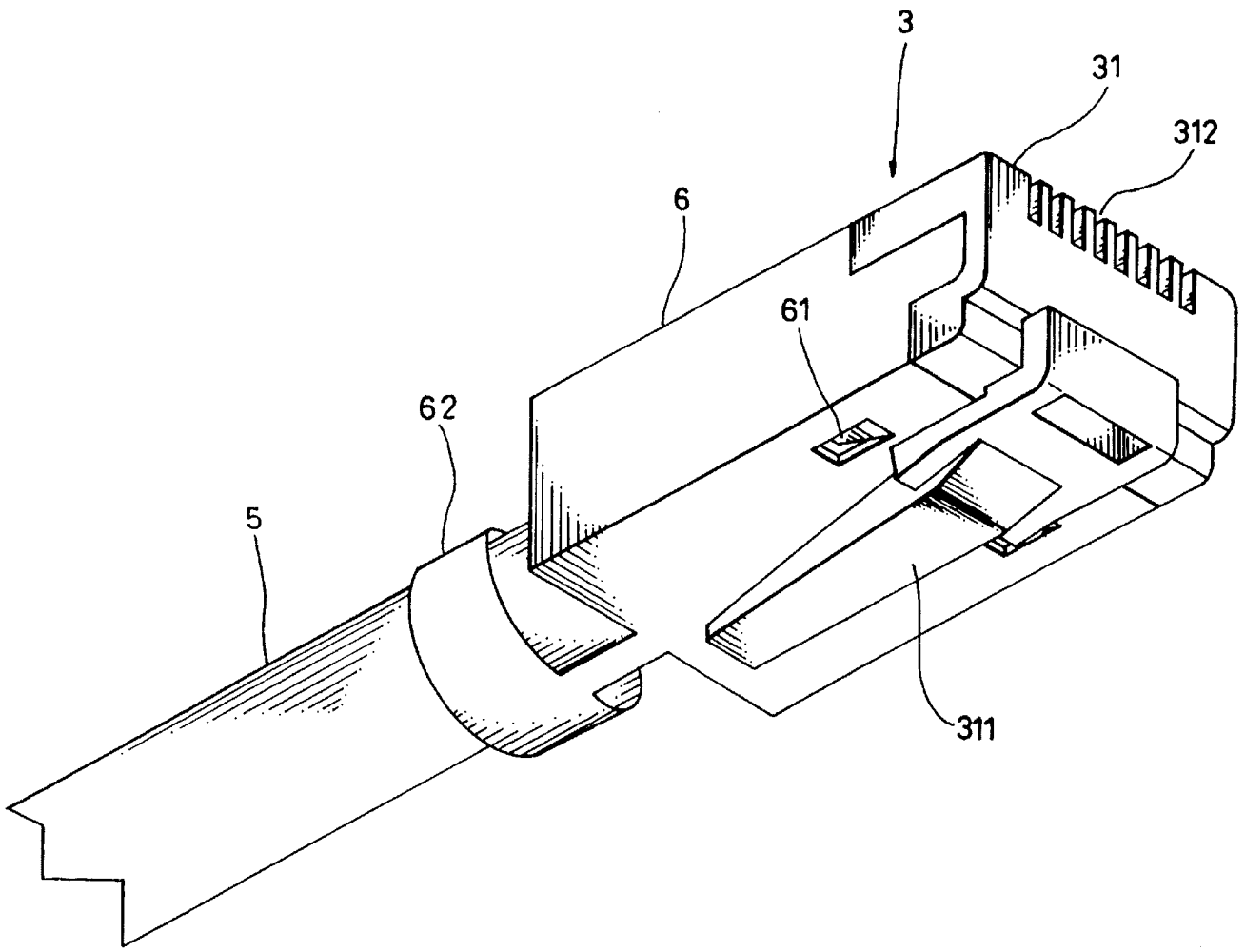
FIG. 5 is an elevational view showing the telephone plug module of FIG. 4 assembled.

Referring to FIG. 5 and FIG. 4 again, the shell 6 receives the rear part 326 of the insert 32, having inward hooks 61 at the bottom respectively fastened to the retaining holes 310 on the plug body 31 and a tubular rear coupling portion 62 mounted around the telephone line 5.

Figure 7:
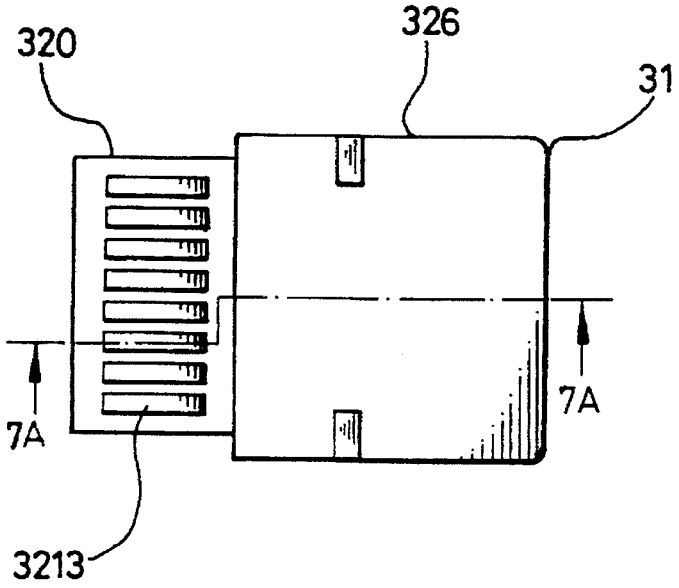
FIG. 7 is a top view of the insert shown in FIG. 4
Figure 7A:
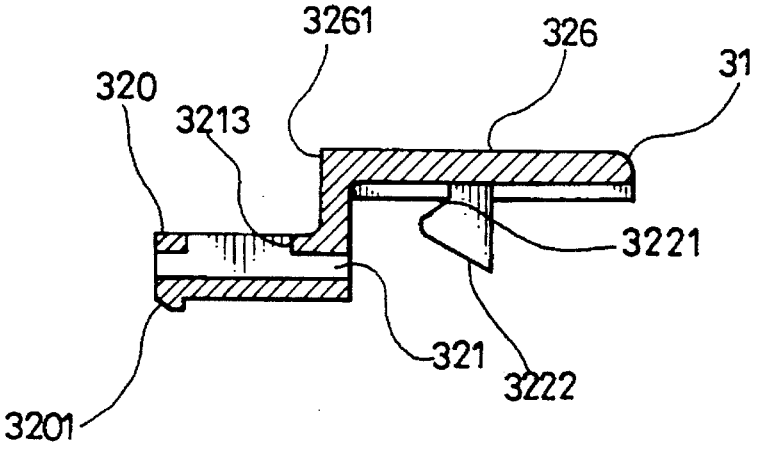
FIG. 7A is a sectional view taken along line 7A—7A of FIG. 7.

Referring to FIGS. 6 through 8, the eight conductors 51 of the telephone line 5 are inserted through the tubular rear coupling portion 62 into the eight parallel slots 321 of the insert 32, then eight contact metal strips 313 are punched into the eight parallel grooves 312 into the vertical holes 3213 to hold down the conductors 51 and to make a respective contact. After the connection of the telephone line 5 to the insert 32, the insert 32 is inserted into the backward chamber 314 of the plug body 31, permitting the retaining block 3201 to be fastened to the downward locating hole 3151. When the retaining block 3201 is fastened to the downward locating hole 3151, the insert 32 is prohibited from backward movement relative to the plug body 31. At the same time, the recessed front edges 3221 and beveled bottom edges 3222 of the projecting strips 322 are stopped against the back flange 316 and beveled tail 317 of the plug body 31, and the vertical front edge 3261 of the rear part 326 of the inserted 32 is stopped against the vertical stop wall 318. After the connection of the plug body 31 and the insert 32, the plug body 31 and the insert 32 are moved backwards into the shell 6, permitting the inward hooks 61 of the shell 6 to be respectively hooked into the retaining holes 310 on the plug body 31.

We claim:

1. A telephone plug module comprising:

a plug body having contact strips in a series of parallel grooves extended from a front end thereof and a longitudinal chamber extended to a back side thereof and communicated with said parallel grooves;

an insert fitted into said longitudinal chamber on said plug body and having a plurality of parallel slots disposed horizontally;

a telephone line carried on said insert and having conductors respectively inserted through the parallel slots on said insert and retained by said contact strips in the parallel grooves of said plug body and respectively electrically connected to said contact strips;

wherein said plug body comprises a downward locating hole inside the longitudinal chamber, a vertical stop wall at a top side behind the parallel grooves of said plug body, a beveled tail, and a back flange spaced between said beveled tail and said vertical stop Wall; said insert comprises a retaining block raised from a bottom wall and fitted into the downward locating hole of said plug body to stop said insert from backward movement relative to said plug body, a vertical stop wall raised from a top side thereof and stopped against the vertical stop wall of said plug body, and two downward projecting strips having a respective recessed front edge and a respective beveled bottom edge respectively stopped against the back flange and bevel tail of said plug body.

* * * * *